US009214733B2

(12) United States Patent
Tasaki et al.

(10) Patent No.: US 9,214,733 B2
(45) Date of Patent: Dec. 15, 2015

(54) ANTENNA DEVICE

(71) Applicant: Hitachi Cable, Ltd., Tokyo (JP)

(72) Inventors: Osamu Tasaki, Hitachi (JP); Tomoyuki Ogawa, Hitachi (JP); Shinsuke Murano, Kasama (JP)

(73) Assignee: Hitachi Cable, Ltd., Tokyo (JP)

( * ) Notice: Subject to any disclaimer, the term of this patent is extended or adjusted under 35 U.S.C. 154(b) by 266 days.

(21) Appl. No.: 13/830,932

(22) Filed: Mar. 14, 2013

(65) Prior Publication Data

US 2013/0314284 A1 Nov. 28, 2013

(30) Foreign Application Priority Data

May 23, 2012 (JP) ..... 2012-117868

(51) Int. Cl.

| | |
|---|---|
| ***H01Q 9/04*** | (2006.01) |
| ***H01Q 1/24*** | (2006.01) |
| ***H01Q 19/10*** | (2006.01) |
| ***H01Q 21/08*** | (2006.01) |
| ***H01Q 21/24*** | (2006.01) |

(52) U.S. Cl.

CPC ..... *H01Q 9/045* (2013.01); *H01Q 1/246* (2013.01); *H01Q 19/106* (2013.01); *H01Q 21/08* (2013.01); *H01Q 21/24* (2013.01)

(58) Field of Classification Search

CPC ... H01Q 9/045; H01Q 21/0075; H01Q 21/06; H01Q 21/08; H01Q 1/246

USPC ..... 343/700 MS, 846, 848

See application file for complete search history.

(56) References Cited

U.S. PATENT DOCUMENTS

| | | | | |
|---|---|---|---|---|
| 5,841,401 | A * | 11/1998 | Bodley et al. | 343/700 MS |
| 6,621,469 | B2 * | 9/2003 | Judd et al. | 343/853 |
| 6,947,008 | B2 * | 9/2005 | Tillery et al. | 343/824 |
| 7,692,592 | B2 * | 4/2010 | Ly et al. | 343/702 |
| 8,199,063 | B2 | 6/2012 | Moon et al. | |
| 2009/0278759 | A1 | 11/2009 | Moon et al. | |

FOREIGN PATENT DOCUMENTS

| | | | |
|---|---|---|---|
| JP | S 62-203404 | A | 9/1987 |
| JP | 2000-134028 | A | 5/2000 |
| JP | 2004-120130 | A | 4/2004 |
| JP | 2008-066878 | A | 3/2008 |
| JP | 2008-543175 | A | 11/2008 |
| JP | 2010-503356 | A | 1/2010 |

OTHER PUBLICATIONS

English Translation of Japanese Office Action dated Oct. 21, 2014.

* cited by examiner

*Primary Examiner* — Hoang V Nguyen

(74) *Attorney, Agent, or Firm* — McGinn IP Law Group, PLLC

(57) ABSTRACT

Provided is an antenna device including a substrate, a metal chassis disposed adjacent a rear surface of the substrate, multiple patch antenna elements formed in an array on a front surface of the substrate, feeding lines formed on the front surface of the substrate and through which electricity is fed to the multiple patch antenna elements, and a ground conductor formed on the rear surface of the substrate in a portion opposite the feeding lines.

6 Claims, 5 Drawing Sheets

ANTENNA DEVICE

The present application is based on Japanese patent application No. 2012-117868 filed on May 23, 2012, the entire contents of which are incorporated herein by reference.

BACKGROUND OF THE INVENTION

1. Field of the Invention

The present invention relates to antenna devices such as one used at a base station for mobile communication.

2. Description of the Related Art

As a typical antenna device used at a base station for mobile communication, the following antenna device is known. The antenna device includes a reflecting plate that reflects radio waves, antenna elements disposed on the front surface of the reflecting plate, and a feeding circuit disposed on the rear surface of the reflecting plate for feeding electricity to the antenna elements (see Japanese Unexamined Patent Application Publication (Translation of PCT Application) No. 2010-503356 and Japanese Unexamined Patent Application No. 2004-120130, for example).

SUMMARY OF THE INVENTION

In such an existing antenna device, a feeding cable extending from a feeding circuit is caused to pass through a hole formed in the reflecting plate and is soldered to the antenna elements, so that the antenna elements and the feeding circuit are electrically connected to one another.

However, there are problems in terms of time and costs to produce such an existing antenna device: an operation of forming a hole in the reflecting plate and an operation of soldering the feeding cable to the antenna elements are required to connect the antenna elements and the feeding circuit to one another.

The present invention has been accomplished in view of the above circumstances. An object of the present invention is to provide an antenna device that can be easily manufactured at a low cost.

The present invention has been made to address the above problems. An antenna device according to an aspect of the present invention includes a substrate; a metal chassis disposed so as to face a rear surface of the substrate; a plurality of patch antenna elements formed in an array on a front surface of the substrate; feeding lines formed on the front surface of the substrate and through which electricity is fed to the plurality of patch antenna elements; and a ground conductor formed on the rear surface of the substrate in a portion opposite the feeding lines.

The substrate may have a rectangular shape. The plurality of patch antenna elements may be formed in a middle portion of the substrate in a short side direction of the substrate and arranged in a long side direction of the substrate. The feeding lines may be disposed in two side portions of the substrate in the short side direction of the substrate so as to extend in the long side direction of the substrate. The feeding lines may branch such that the electricity is fed to the plurality of patch antenna elements.

The ground conductor may include ground patterns formed on the two side portions of the substrate in the short side direction so as to be spaced apart from each other.

The substrate may be disposed such that the ground patterns formed so as to be spaced apart from each other are in contact with the metal chassis so as to be electrically connected to each other via the metal chassis.

Portions of each feeding line may be formed on the rear surface of the substrate at positions near the plurality of patch antenna elements, each portion of the feeding line formed on the rear surface of the substrate and a corresponding one of the feeding lines formed on the front surface of the substrate may be electrically connected to each other through a via hole, and each portion of the feeding line formed on the rear surface of the substrate and a corresponding one of the patch antenna elements may be electrically connected to each other through a via hole.

The ground conductor may include a ground pattern formed on the entirety of the rear surface of the substrate. Pattern-free portions in which the ground patterns are not formed may be formed on the rear surface of the substrate in portions opposite the plurality of patch antenna elements.

Each pattern-free portion may vertically extend away from a corresponding one of the patch antenna elements and upper and lower portions of the pattern-free portion vertically extending away from the patch antenna element may have different lengths.

The metal chassis may be formed by a bending operation so as to have a recess in a portion opposite the middle portion of the substrate in the short side direction of the substrate, the middle portion being one in which the plurality of patch antenna elements are formed, the recess being open in a direction away from the substrate.

The present invention can provide an antenna device that can be easily manufactured at a low cost.

BRIEF DESCRIPTION OF THE DRAWINGS

The foregoing and other exemplary purposes, aspects and advantages will be better understood from the following detailed description of the invention with reference to the drawings, in which:

FIG. 1A is an exploded perspective view of the antenna device and FIG. 1B is a cross-sectional view of the antenna device.

FIG. 2A is a plan view of a front surface of the substrate viewed from the front surface side, FIG. 2B is a perspective view of a rear surface of the substrate viewed through the front surface, and FIG. 2C is an enlarged view of the antenna device of FIG. 2A.

FIG. 3A is a cross-sectional view of the antenna device, FIG. 3B is a plan view of a front surface of a substrate viewed from the front surface side, and FIG. 3C is a perspective view of a rear surface of the substrate viewed through the front surface of the substrate.

FIG. 4A is a plan view of a front surface of the substrate viewed from the front surface side, FIG. 4B is a perspective view of the rear surface of the substrate viewed through the front surface, FIG. 4C is an enlarged view of the front surface of FIG. 4A and the rear surface of FIG. 4B that are superposed with each other, and FIG. 4D is a further enlarged view of the front surface and the rear surface illustrated in FIG. 4C.

FIG. 5A is a plan view of a front surface of the substrate viewed from the front surface side, FIG. 5B is a perspective view of a rear surface viewed through the front surface, FIG. 5C is an enlarged view of the front surface of FIG. 5A and the rear surface of FIG. 5B that are superposed with each other, and FIG. 5D is a further enlarged view of the front surface and the rear surface illustrated in FIG. 5C.

DESCRIPTION OF THE PREFERRED EMBODIMENTS

Figure 1A:
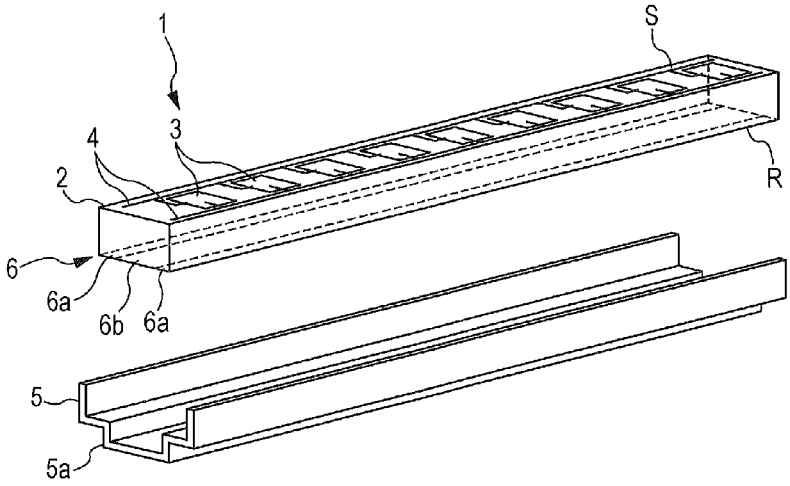
FIGS. 1A and 1B illustrate an antenna device according to an embodiment of the present invention, where

Referring now to the drawings, an embodiment of the present invention will be described.

Figure 1B:
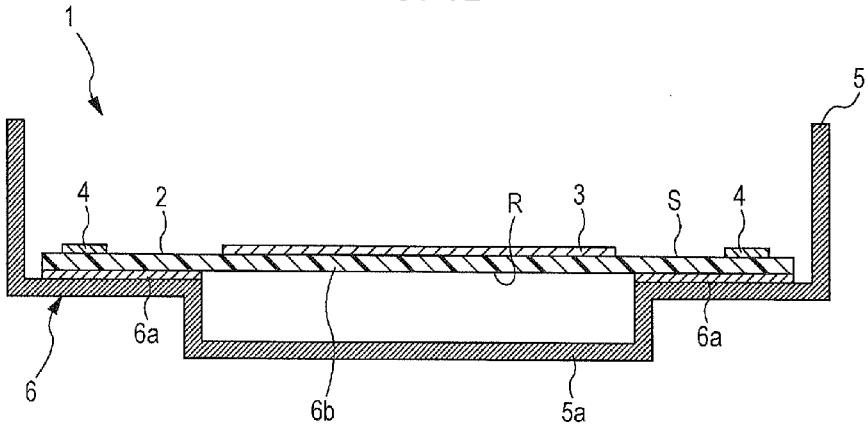

FIGS. 1A and 1B illustrate an antenna device 1 according to an embodiment of the present invention, where FIG. 1A is an exploded perspective view of the antenna device 1 and FIG. 1B is a cross-sectional view of the antenna device 1.

As illustrated in FIGS. 1A and 1B, the antenna device 1 includes a substrate 2, a metal chassis 5 disposed adjacent a rear surface R of the substrate 2, multiple patch antenna elements 3 formed in an array on a front surface S of the substrate 2, feeding lines (transmission lines) 4 formed on the front surface S of the substrate 2 and through which electricity is fed to the multiple patch antenna elements 3, and ground conductors 6 formed on the rear surface R of the substrate 2 in portions opposite the feeding lines 4.

A rigid board made of a dielectric substance such as an epoxy board is used as the substrate 2. In the embodiment, a double-sided board having a rectangular shape and a thickness of 0.8 mm is used as the substrate 2. In FIG. 1A, the substrate 2 is illustrated as being thicker than it actually is for easy comprehension.

As illustrated in FIGS. 1A, 1B, and 2A to 2C, the multiple patch antenna elements 3 are disposed in a middle portion of the substrate 2 in the short side direction at equal intervals in the long side direction of the substrate 2. Although this embodiment includes substantially rectangular patch antenna elements 3, the shape of the patch antenna elements 3 is not limited to a rectangular shape. In addition, although this embodiment includes nine patch antenna elements 3, the number of the patch antenna elements 3 is not limited to nine.

The feeding lines 4 are microstrip lines formed on the front surface S of the substrate 2. Each feeding line 4 branches to distribute feeding signals fed from a feeding portion 4*a* among the patch antenna elements 3. More specifically, the feeding lines 4 are disposed on both sides of the substrate 2 in the short side direction and extend in the long side direction of the substrate 2. Each feeding line 4 branches so as to distribute electricity among the patch antenna elements 3. The reason why the conductor width of the feeding lines 4 differs at different positions is to match impedance by adjusting the impedance through adjustment of the conductor width.

To efficiently feed electricity to all the patch antenna elements 3, the feeding portion 4*a* that feeds electricity to the feeding lines 4 is preferably disposed at a substantially middle position of the substrate 2 in the long side direction. A center conductor of a feeding cable extending from radio equipment, not illustrated, is soldered to the feeding portion 4*a* and is electrically connected to the feeding portion 4*a*. An outer conductor of the feeding cable is electrically connected to the ground conductors 6.

In the embodiment, the ground conductors 6 include ground patterns 6*a* formed so as to be spaced apart from each other on both sides of the substrate 2 in the short side direction. A pattern-free portion 6*b* that does not include ground patterns 6*a* is formed between the ground patterns 6*a* such that no ground patterns 6*a* are formed opposite the patch antenna elements 3.

The metal chassis 5 is formed in the following manner. Firstly, widthwise both end portions of a plate are bent toward the substrate 2 so that the end portions extend vertically and the plate is formed into an angular C shape when viewed in a cross section. Then, the bottom of the angular-C-shaped plate is further bent so that a recess 5*a* is formed in a portion opposite the middle portion of the substrate 2 in the short side direction of the substrate 2, the middle portion being one in which the multiple patch antenna elements 3 are formed. The recess 5*a* is open in a direction away from the substrate 2. In the embodiment, the metal chassis 5 is made of an aluminum plate having a thickness of 1.2 mm (aluminum chassis).

In the embodiment, the width of the recess 5*a* of the metal chassis 5 is substantially the same as the width of the pattern-free portion 6*b* and the substrate 2 is disposed such that the surfaces of the ground patterns 6*a* that are opposite the surfaces facing the substrate 2 are in contact with side portions of the metal chassis 5 on the side of the recess 5*a*. Thus, the ground patterns 6*a* formed so as to be spaced apart from each other are electrically connected via the metal chassis 5. The metal chassis 5 functions as a reflecting plate that reflects radio waves radiated by the patch antenna elements 3 and as a constituent component of the ground conductors 6 for the feeding lines 4. The recess 5*a* of the metal chassis 5 has a function to increase the distance between the patch antenna elements 3 and the metal chassis 5 (ground conductors 6).

Generally, it is difficult to design an antenna device if an antenna element and a ground conductor are disposed too close to each other because, in this case, the width of frequencies (frequency bandwidth) of radio waves radiated from the antenna element is too narrow. An antenna element emits an electromagnetic field to a free space. Thus, by increasing the distance from the ground conductor, the antenna element can more efficiently emits an electromagnetic field and the bandwidth can be increased further. For this reason, in order to improve the antenna function of the antenna device 1, no ground patterns 6*a* are formed on the rear surface of the substrate in a portion opposite the patch antenna elements 3 and a recess 5*a* is formed so that only the portion of the metal chassis 5 opposite the patch antenna elements 3 is separated from the substrate 2.

Here, the distance between the patch antenna elements 3 and the metal chassis 5 (ground conductors 6) is secured by forming the recess 5*a* during a bending operation for forming the metal chassis 5. However, this is not the only way of securing the distance. If the metal chassis 5 has a large thickness, a groove may be formed in the metal chassis 5 instead of forming the recess 5*a*.

In the embodiment, the metal chassis 5 is made of aluminum. Since aluminum cannot be soldered in a generally used manner, the outer conductor of the feeding cable is preferably connected to the ground patterns 6*a*. In other words, forming the ground patterns 6*a* facilitates connection of the outer conductor of the feeding cable to the antenna devices.

The ground conductors 6 may also be constituted only of the metal chassis 5 without the ground patterns 6*a*. In this case, a single-sided board (a dielectric board having a wiring pattern on only one surface of the board) can be used as the substrate 2, thereby reducing the cost. However, it is difficult to design an antenna device including such a ground conductor 6 because the impedance can change due to a change of the distance between a feeding line 4 and the metal chassis 5. To prevent the change in impedance, the metal chassis 5 needs to be processed with high precision or an additional mechanism has to be provided that holds the substrate 2 and the metal chassis 5 such that the substrate 2 and the metal chassis 5 are tightly attached to each other.

Although not illustrated, the substrate 2 and the metal chassis 5 are contained in a cylindrical radome (cover). For example, a radome made of fiberglass reinforced plastic (FRP) may be used for this radome. The antenna device 1 is installed such that the longitudinal direction of the antenna device 1 (long side direction of the substrate 2) becomes the vertical direction.

Operations of the embodiment will be described now.

The antenna device 1 according to the embodiment includes the substrate 2, the metal chassis 5 disposed adjacent the rear surface R of the substrate 2, the multiple patch antenna elements 3 formed in an array on the front surface S of the substrate 2, feeding lines 4 formed on the front surface S of the substrate 2 and through which electricity is fed to the multiple patch antenna elements 3, and the ground conductors 6 formed on the rear surface R of the substrate 2 in portions opposite the feeding lines 4.

In this configuration, the patch antenna elements 3 and the feeding lines 4 are electrically connected to one another. Thus, unlike in the case of existing antenna devices, assembly of an antenna device having this configuration does not involve an operation of forming a hole in a reflecting plate or an operation of soldering a feeding cable extending from a feeding circuit to an antenna element. Thus, the antenna device 1 having a simple structure that does not require an operation of manually connecting the feeding circuit to the antenna element while being assembled is accomplished. Consequently, the antenna device 1 can be assembled with short time and easily manufactured at a low cost.

In this embodiment, the substrate 2 is disposed such that the surfaces of the ground patterns 6*a*, which are formed so as to be spaced apart from each other, opposite the surfaces facing the substrate 2 are brought into contact with the metal chassis 5 so that the ground patterns 6*a* are electrically connected to each other via the metal chassis 5.

If the ground patterns 6*a* are electrically disconnected from each other, the antenna device may operate unstably due to causes such as a difference in ground level. On the other hand, when the ground patterns 6*a* are electrically connected to each other via the metal chassis 5, the antenna device can operate stably. Moreover, since the metal chassis 5 is directly supported by the substrate 2, the antenna device is easily assembled. Note that electrical connection between the ground patterns 6*a* and the metal chassis 5 is not an essential requirement. The scope of the present invention naturally includes antenna devices such as one in which an insulating film or an insulating sheet is sandwiched between each ground pattern 6*a* and the metal chassis 5.

In this embodiment, the metal chassis 5 is formed by a bending operation so as to have a recess 5*a* in a portion opposite the middle portion of the substrate 2 in the short side direction of the substrate 2, the middle portion being one in which the multiple patch antenna elements 3 are formed, the recess 5*a* being open in a direction away from the substrate 2. Since the distance between the patch antenna elements 3 and the ground conductors 6 can be secured, the antenna device 1 that has a wide bandwidth and that can be easily designed can be accomplished.

In this embodiment, the case where the entirety of the feeding lines 4 are formed on the front surface S of the substrate 2 is described. However, if adjustment of the impedance or adjustment of the antenna properties is difficult due to the feeding lines 4 being formed on the front surface S, portions of the feeding lines 4 may be formed on the rear surface R of the substrate 2.

Figure 3A:
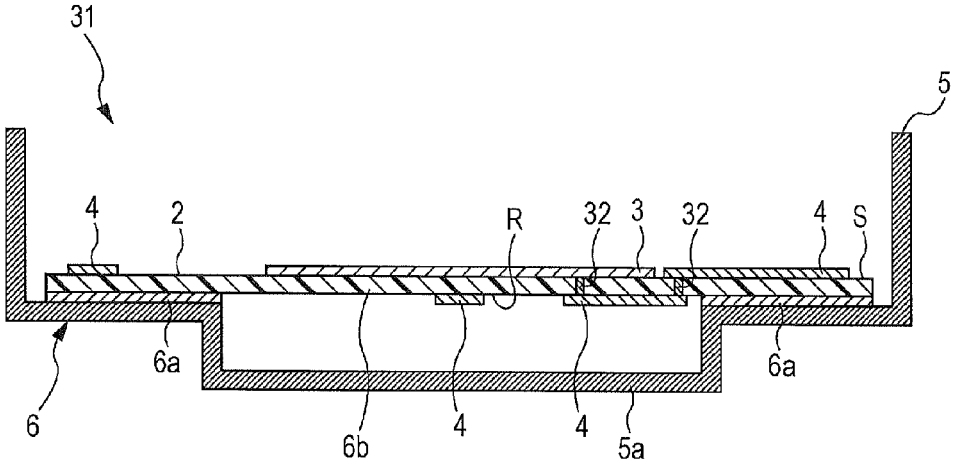
FIGS. 3A to 3C illustrate a modification of the antenna device illustrated in FIGS. 1A and 1B, where
Figure 3B:
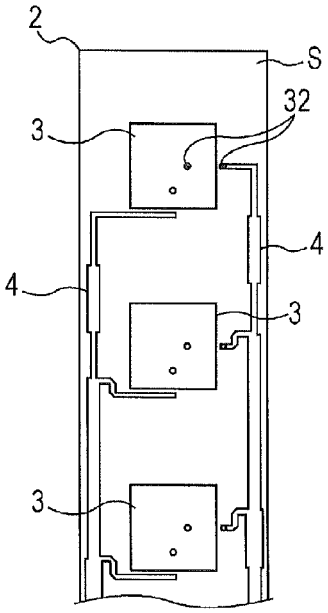
Figure 3C:
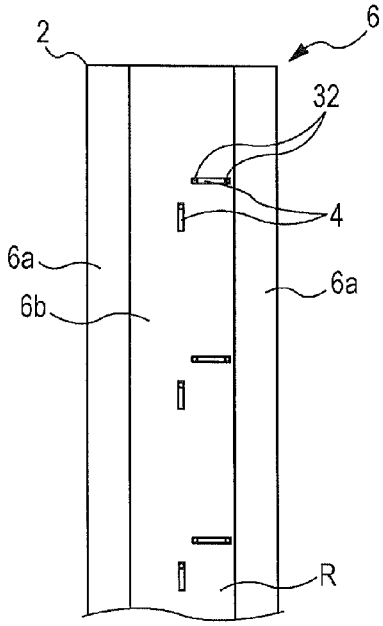

More specifically, as illustrated in an antenna device 31 illustrated in FIGS. 3A to 3C, portions of the feeding lines 4 may be formed on the rear surface R of the substrate 2 (in the pattern-free portion 6*b*) near the patch antenna elements 3. Then, the feeding lines 4 formed on the front and rear surfaces of the substrate 2 may be electrically connected to each other through via holes (through holes) 32 and the feeding lines 4 formed on the rear surface R of the substrate 2 and the patch antenna elements 3 may be electrically connected to one another.

Figure 2A:
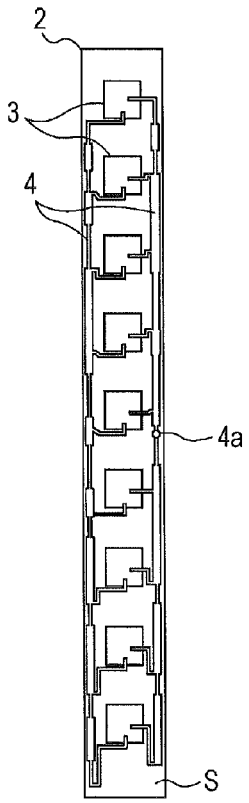
FIGS. 2A to 2C illustrate a substrate of the antenna device illustrated in FIGS. 1A and 1B, where
Figure 2B:
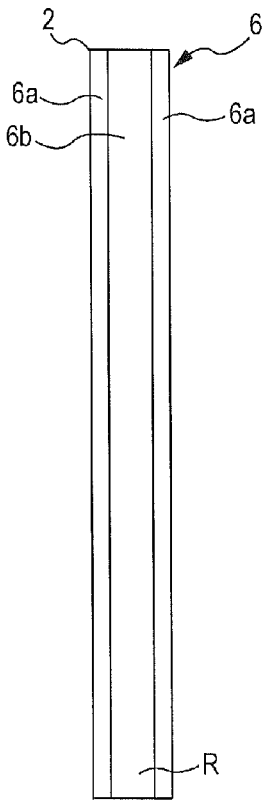
Figure 2C:
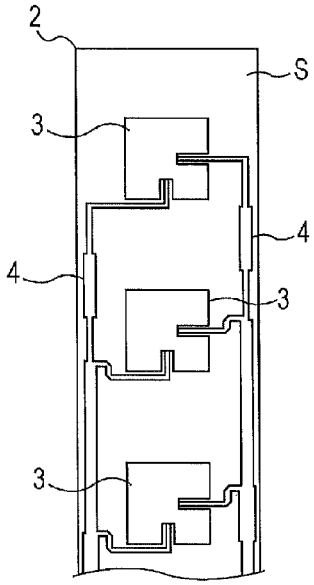

In the case where the entirety of the feeding lines 4 are formed on the front surface S of the substrate 2, each patch antenna element 3 is required to have a cutout so that the patch antenna element 3 is fed with electricity at a position near the center (see FIG. 2C). Consequently, the patch antenna elements 3 have a complicated shape and thus may be difficult to design.

On the other hand, in the case where portions of the feeding lines 4 are formed on the rear surface R of the substrate 2 near the patch antenna elements 3, the feeding lines 4 formed on the rear surface R can extend to the positions opposite the patch antenna elements 3 and thus can be connected to the patch antenna elements 2 through the via holes 32. Thus, the patch antenna elements 3 can have a simple rectangular shape and are easy to design.

As illustrated in FIGS. 4A to 4D, a ground conductor 6 may be constituted by a ground pattern 6*c* formed on the entirety of the rear surface R of the substrate 2 excluding portions on the rear surface R opposite the patch antenna elements 3. The portions opposite the patch antenna elements 3 form pattern-free portions 6*b*. The pattern-free portions 6*b* have a rectangular shape slightly larger than the shape of the patch antenna elements 3.

In this case, the side portions of the ground pattern 6*c* on the rear surface of the substrate 2 are integrated into one ground pattern 6*c*, thereby eliminating problems such as an unstable operation of the antenna device due to a difference in ground level. Consequently, the metal chassis 5 and the ground pattern 6*c* are no longer required to be in contact with each other, so that the substrate 2 and the metal chassis 5 may be disposed so as to be spaced apart from each other. If the distance between the substrate 2 and the metal chassis 5 is sufficiently large, the recess 5*a* of the metal chassis 5 may not be formed.

Figure 4A:
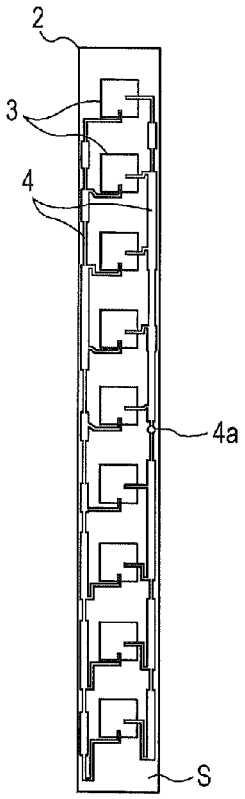
FIGS. 4A to 4D illustrate a substrate according to a modification of the embodiment of the present invention, where
Figure 4B:
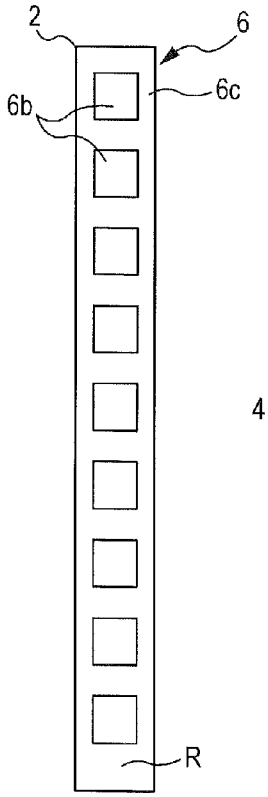
Figure 4C:
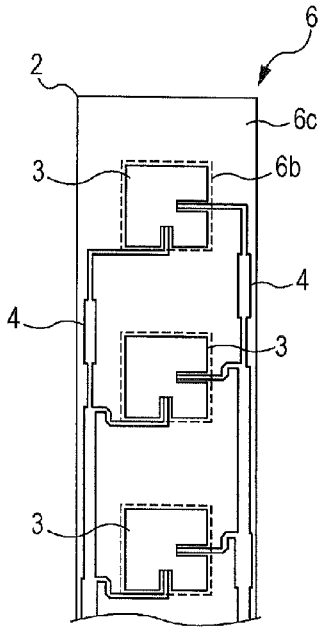
Figure 4D:
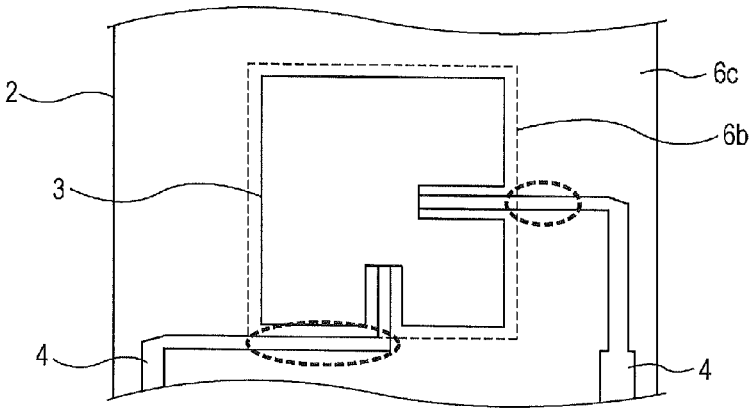
Figure 5A:
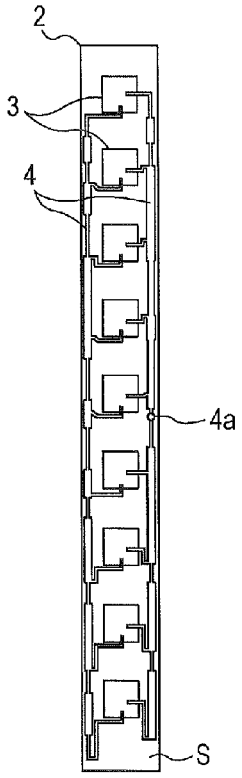
FIGS. 5A to 5D illustrate a substrate according to a modification of the embodiment of the present invention, where
Figure 5B:
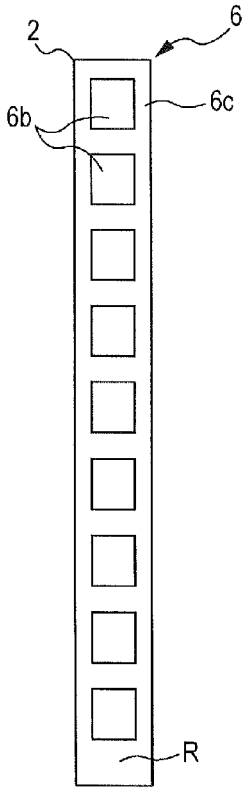
Figure 5C:
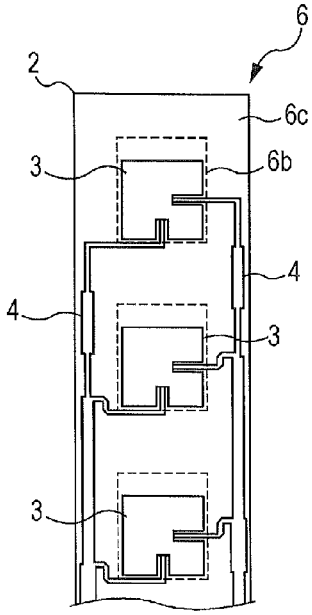
Figure 5D:
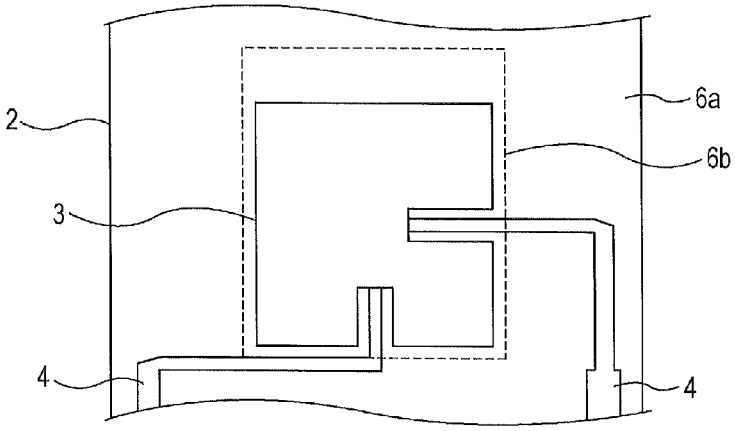

As seen in portions encircled by bold broken lines in FIG. 4D, the ground pattern 6*c* extends to portions opposite the portions of the feeding lines 4 that are about to reach the patch antenna elements 3. Thus, electricity can be fed to the patch antenna elements 3 without an impedance mismatch being caused up to positions at which the electricity is just about to be input to the patch antenna elements 3, thereby preventing these portions of the feeding lines 4 from functioning as an antenna. The antenna device having this configuration can be designed easily.

As illustrated in FIGS. 5A to 5D, each pattern-free portions 6*b* may vertically extend away from the corresponding patch antenna element 3 and upper and lower portions of the pattern-free portion 6*b* vertically extending away from the corresponding patch antenna element 3 may have different lengths. The vertical direction here is the long side direction of the substrate 2.

By changing the length of the upper and lower portions of each pattern-free portion 6*b* vertically extending away from the corresponding patch antenna element, the vertical-plane pattern can be changed. By tilting the antenna device having the above configuration such that its radiation direction comes closer to the ground by only a few degrees, the gain can be increased while the sky side lobe is reduced since the antenna device is installed at a high position such as on the rooftop of a building.

The present invention is not limited to the above-described embodiment and may be modified in various manners within the scope not departing from the gist of the invention.

Further, it is noted that Applicant's intent is to encompass equivalents of all claim elements, even if amended later during prosecution.

What is claimed is:

1. An antenna device comprising:

a substrate;

a metal chassis disposed adjacent a rear surface of the substrate;

a plurality of patch antenna elements formed in an array on at least a front surface of the substrate;

feeding lines formed on the front surface of the substrate and through which electricity is fed to the plurality of patch antenna elements; and a ground conductor formed on the rear surface of the substrate in a portion opposite the feeding lines, wherein the substrate has a rectangular shape, wherein the plurality of patch antenna elements are formed in a middle portion of the substrate in a short side direction of the substrate and arranged in a long side direction of the substrate, and wherein the feeding lines are disposed in two side portions of the substrate in the short side direction of the substrate so as to extend in the long side direction of the substrate, the feeding lines branching such that the electricity is fed to the plurality of patch antenna elements, wherein the ground conductor includes ground patterns formed on the two side portions of the substrate in the short side direction so as to be spaced apart from each other.

2. The antenna device according to claim 1, wherein the substrate is disposed such that the ground patterns formed so as to be spaced apart from each other are in contact with the metal chassis so as to be electrically connected to each other via the metal chassis.

3. The antenna device according to claim 1, wherein portions of each feeding line are formed on the rear surface of the substrate at positions near the plurality of patch antenna elements, each portion of the feeding line formed on the rear surface of the substrate and a corresponding one of the feeding lines formed on the front surface of the substrate are electrically connected to each other through a via hole, and each portion of the feeding line formed on the rear surface of the substrate and a corresponding one of the patch antenna elements are electrically connected to each other through a via hole.

4. The antenna device according to claim 1, wherein the metal chassis is formed by a bending operation so as to have a recess in a portion opposite the middle portion of the substrate in the short side direction of the substrate, the middle portion being one in which the plurality of patch antenna elements are formed, the recess being open in a direction away from the substrate.

5. An antenna device comprising:

a substrate;

a metal chassis disposed adjacent a rear surface of the substrate;

a plurality of patch antenna elements formed in an array on at least a front surface of the substrate;

feeding lines formed on the front surface of the substrate and through which electricity is fed to the plurality of patch antenna elements; and a ground conductor formed on the rear surface of the substrate in a portion opposite the feeding lines, wherein the substrate has a rectangular shape, wherein the plurality of patch antenna elements are formed in a middle portion of the substrate in a short side direction of the substrate and arranged in a long side direction of the substrate, and wherein the feeding lines are disposed in two side portions of the substrate in the short side direction of the substrate so as to extend in the long side direction of the substrate, the feeding lines branching such that the electricity is fed to the plurality of patch antenna elements, wherein the ground conductor includes a ground pattern formed on the entirety of the rear surface of the substrate, and wherein pattern-free portions in which the ground patterns are not formed are formed on the rear surface of the substrate in portions opposite the plurality of patch antenna elements.

6. The antenna device according to claim 5, wherein each pattern-free portion vertically extends away from a corresponding one of the patch antenna elements and upper and lower portions of the pattern-free portion vertically extending away from the patch antenna element have different lengths.

* * * * *